US005138913A

United States Patent [19]

Chen

[11] Patent Number: 5,138,913

[45] Date of Patent: Aug. 18, 1992

[54] AUTOMATIC SCREW FEEDING MECHANISM FOR AN AUTOMATIC SCREW DRIVING DEVICE

[76] Inventor: Abraham Chen, No. 66, Wen-Chang Rd., Shih-Lin Dist., Taipei, Taiwan

[21] Appl. No.: 764,910

[22] Filed: Sep. 24, 1991

[51] Int. Cl.[5] ..... B25B 23/04

[52] U.S. Cl. ..... 81/434; 81/57.37

[58] Field of Search ..... 81/434, 57.37, 435, 81/54

[56] References Cited

U.S. PATENT DOCUMENTS

| | | | |
|---|---|---|---|
| 4,428,261 | 1/1984 | Takatsu et al. | 81/434 |
| 4,581,964 | 4/1986 | Takatsuru | 81/434 |
| 5,083,483 | 1/1992 | Takagi | 81/434 |

*Primary Examiner*—Bruce M. Kisliuk
*Assistant Examiner*—Lawrence Cruz
*Attorney, Agent, or Firm*—Nixon & Vanderhye

[57] ABSTRACT

An automatic screw feeding mechanism includes a connector plate mounted on a rear open end of a hollow casing. The connector plate has a central opening to receive one end of an automtic screw driving device. A guide member has a front end extending out of a front open end of the casing, to be placed against an operating surface. The casing is slidably mounted on the guide member. An axial seat is provided in the guide member and defines an axial opening that is aligned with the central opening of the connector plate. The axial seat has a ratchet wheel rotatably provided on one side thereof. A feed belt extends into the guide member in front of the axial seat. The ratchet wheel engages the feed belt so as to align a first screw of the feed belt with the axial opening. A spring connects the axial seat and the connector plate. The spring is compressed when the casing is urged by the screw driving device to move from an initial position to a second position, wherein the tool bit extends into the axial opening to rotatably drive the first screw into the operating surface. The ratchet wheel is rotated by a predetermined angular rotation when the casing moves back to the initial position after a screw driving operation so that the ratchet wheel can align a second screw with the axial opening.

8 Claims, 8 Drawing Sheets

AUTOMATIC SCREW FEEDING MECHANISM FOR AN AUTOMATIC SCREW DRIVING DEVICE

BACKGROUND OF THE INVENTION

1. Field of the Invention

The invention relates to an automatic screw driving device, more particularly to an automatic screw feeding mechanism for an automatic screw driving device.

2. Description of the Related Art

Present manufacturing trends indicate that the popularity of screws as fastening or locking means has increased worldwide. Thus, there is a need to improve present screw driving operations so as to reduce the amount of time in executing the same.

Currently, an electric drill having a rotatable tool bit is used to drive a screw into an operating surface. Although the screw driving operation has been made easier, each screw still has to be gathered from a pile of screws and must be manually held at the desired position before the actual driving operation.

Although there already exists an automatic nail driving device which obviates the need for gathering nails from a big pile and holding the nails at the desired positions, such a construction cannot be used for screws. A nail is simply struck at the head portion in order to be embed in the operating surface. A screw, however, has to be rotated when driven into the operating surface.

SUMMARY OF THE INVENTION

Therefore, the main objective of the present invention is to provide an automatic screw feeding mechanism for use with an automatic screw driving device.

Accordingly, the preferred embodiment of an automatic screw feeding mechanism of the present invention comprises: a feed belt including an elongated strap formed with a plurality of spaced and aligned positioning rings, said strap having a longitudinal side provided with a plurality of spaced notches, each of said notches being disposed between two adjacent positioning rings, said feed belt further including a plurality of screws each having a shaft portion retained in one of the positioning rings; a hollow casing having a rear open end and a front open end; a connector plate mounted on the rear open end of the hollow casing and having a central opening to releasably engage one end of an automatic screw driving device, said central opening serving as a passage for a rotating tool bit of the automatic screw driving device; a guide member provided inside the casing and having a front end extending out of the front open end of the casing, said front end of the guide member being placed against an operating surface, said casing being slidably mounted on the guide member, said guide member including a pair of spaced guide plates and a connecting rod joining the guide plates; an axial seat mounted between the guide plates and defining an axial opening aligned with the central opening of the connector plate, said axial seat having a ratchet wheel rotatably provided on one side thereof, said ratchet wheel having a periphery formed with a set of spaced ratchet teeth, said feed belt being provided between the guide plates in front of the axial seat, one of the ratchet teeth engaging one of the notches on the feed belt in order to align one of the screws with the axial opening of the axial seat; a first spring means connecting the axial seat and the connector plate, said first spring means being compressed when the casing is urged by the automatic screw driving device to move from an initial position to a second position, wherein the tool bit extends into the axial opening to rotatably drive an aligned one of the screws into the operating surface and release the aligned one of the screws from the strap during a screw driving operation; and a hook means for rotating the ratchet wheel by a predetermined angular rotation when the first spring means expands to move the casing back to the initial position after the execution of a screw driving operation, said ratchet wheel being rotated by the hook means so that the ratchet wheel can engage a succeeding one of the notches on the feed belt in order to align a succeeding one of the screws with the axial opening.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
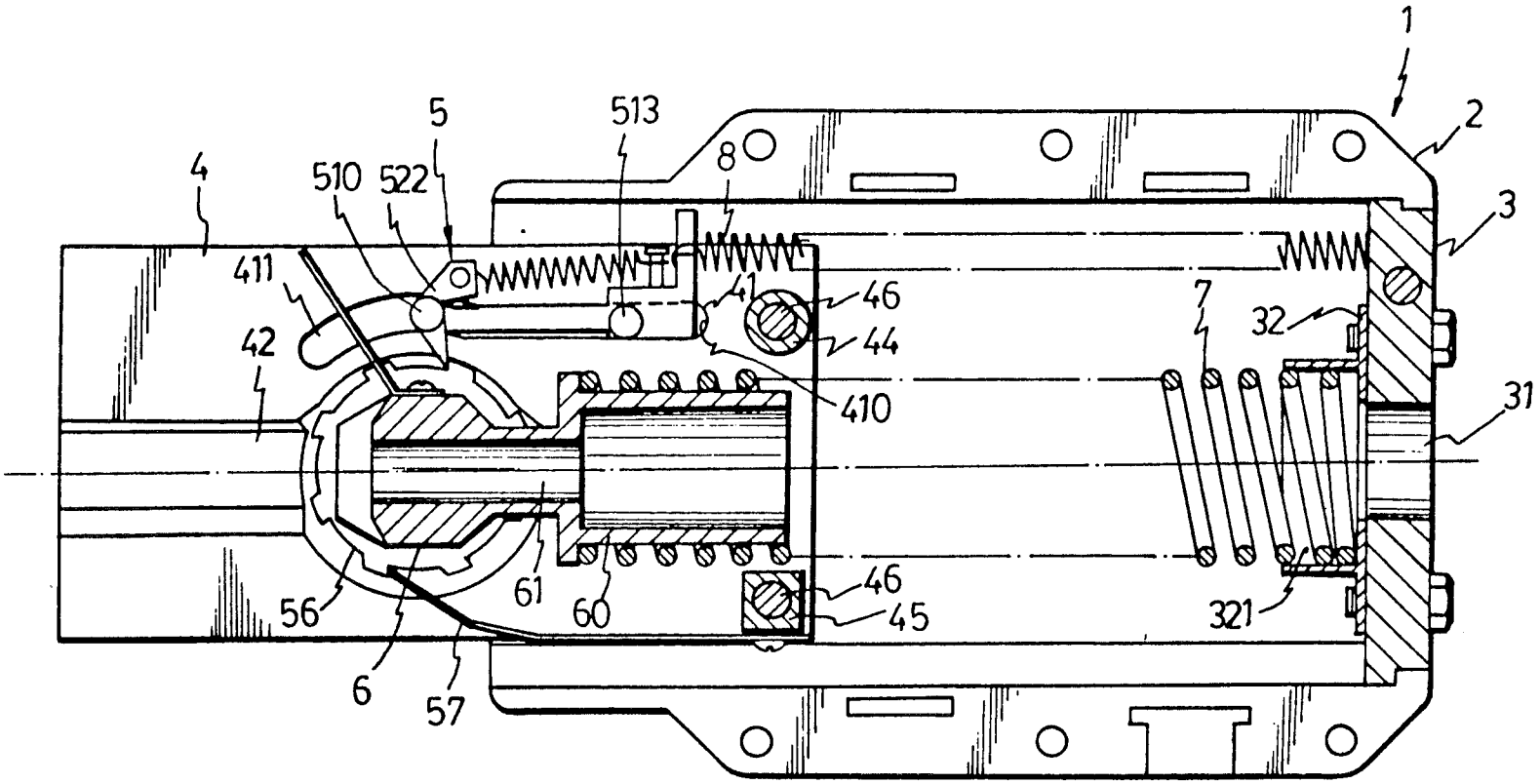
FIG. 1 is a sectional view of the preferred embodiment of an automatic screw feeding mechanism according to the present invention.
Figure 3:
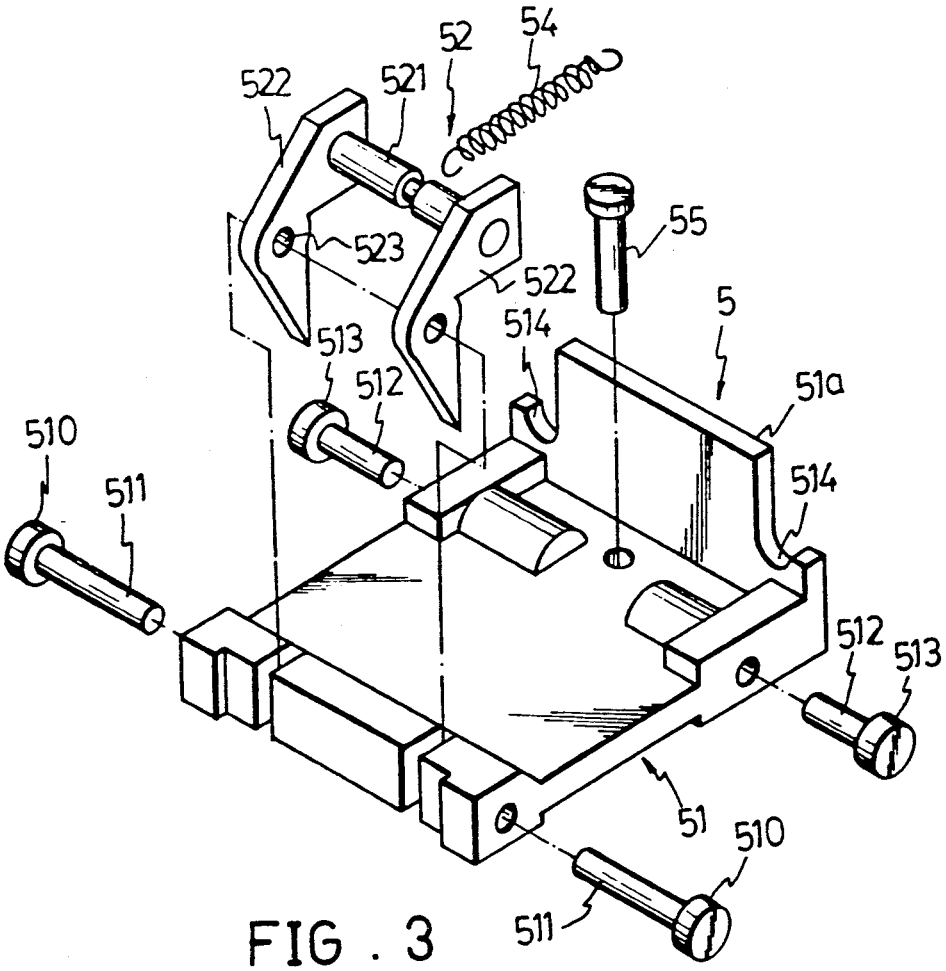
FIG. 3 is an exploded view of a hook means of the preferred embodiment.

Referring to FIG. 1, the automatic screw feeding mechanism 1 of the present invention is shown to mainly comprise a hollow casing 2 and a connector plate 3 provided on a rear open end of the casing 2. A pair of spaced rectangular guide plates 4 is provided inside the casing 2. (Only one guide plate 4 is shown). A hook means 5 is movably provided between the guide plates 4. (A detailed illustration of the hook means 5 is shown in FIG. 3). An axial seat 6 is mounted between the guide plates 4 underneath the hook means 5. A primary biasing spring 7 is provided between the axial seat 6 and the connector plate 3. A pair of secondary biasing springs 8 connect the hook means 5 and the connector plate 3 (Only one secondary biasing spring 8 is shown). The connector plate 3 has a central opening 31. A spring support seat 32 is screwed to an inner side of the connector plate 3. The spring support seat 32 defines a receiving space 321 which receives and properly positions one end of the primary biasing spring 7.

Each of the guide plates 4 is formed with a rail groove 41. The rail groove 41 has a horizontal section 410 and a downwardly curving section 411 disposed on a front end of the horizontal section 410. The inner sides of the guide plates 4 are formed with aligned longitudinal guide grooves 42 which are semicircular in cross section and which extend horizontally from the front end of the guide plates 4.

The axial seat 6 defines an axial opening 61 which is aligned with the central opening 31 of the connector plate 3. The rear end of the axial seat 6 is provided with a tubular projection 60. The other end of the primary biasing spring 7 is provided around the tubular projection 60.

Figure 2:
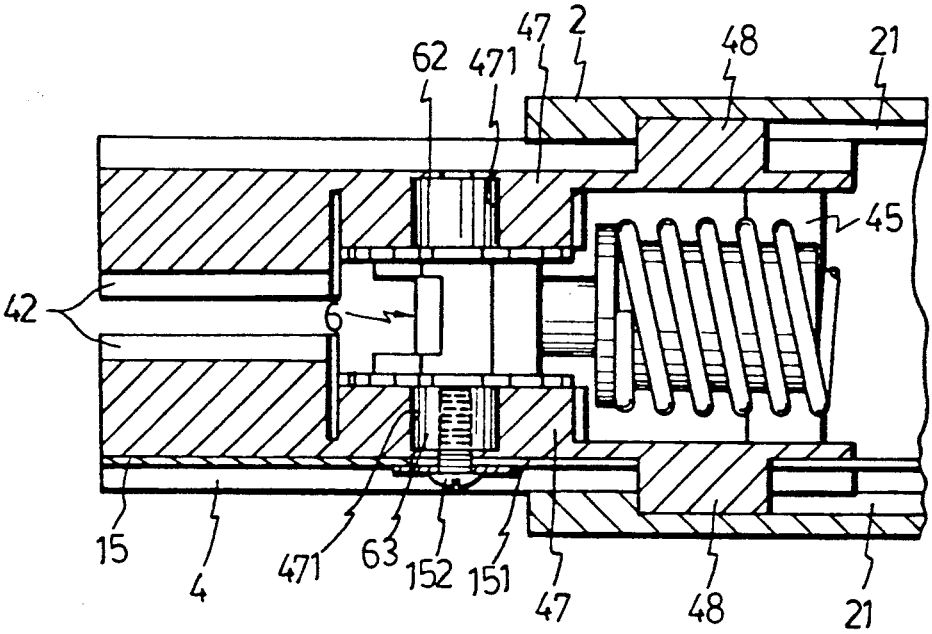
FIG. 2 is a transverse sectional view of the front portion of the preferred embodiment.

FIG. 2 is a horizontal section of the automatic screw feeding mechanism 1 shown in FIG. 1. (The axial seat 6 was not drawn in detail in order to simplify the succeeding discussion). The inner surface of the casing 2 is formed with a pair of oppositely disposed longitudinal slide grooves 21. The outer surfaces of the guide plates 4 are each provided with an engaging projection 48. The engaging projections 48 are disposed adjacent to the rear ends of the guide plates 4 and extend into the respective slide groove 21, thereby slidably mounting the casing 2 onto the guide plates 4. The guide grooves 42 of the guide plates 4 define a passage to receive a feed belt (not shown). The respective inner surfaces of the guide plates 4 are each provided with an inward mounting projection 47. Each mounting projection 47 is formed with a mounting groove 471. The front end of the axial seat 6 has a pair of oppositely extending mounting sockets, 62 and 63, which project into the mounting grooves 471. The axial seat 6 is thus stationary relative to the guide plates 4.

A resisting plate 15 is disposed on an outer side of one of the guide plates 4. The engaging projection 48 of the guide plate 4 extends through an elongated first slot (not shown) on the resisting plate 15. The resisting plate 15 has a second slot 151. A screw 152 extends into the second slot 151 and is used to fasten the resisting plate 15 to the mounting socket 63 of the axial seat 6.

The respective inner surfaces of the guide plates 4 are further provided with upper and lower inwardly projecting connecting rods, 44 and 45, which are disposed adjacent to the rear ends of the guide plates 4 (See FIG. 1). Screws 46 are provided to fasten the connecting rods, 44 and 45, to thereby join the guide plates 4.

FIG. 3 is an exploded view of the hook means 5 of the preferred embodiment. The hook means 5 comprises a slide frame 51, a hook member 52 pivoted on a front end of the slide frame 51, a spring 54 having one end connected to the hook member 52 and a hooking post 55 mounted near a rear end of the slide frame 51. The rear end of the slide frame 51 is provided with an upright wall (51*a*). The two sides of the upright wall (51*a*) are each provided with a hook groove 514. Each of the secondary biasing springs 8 has one end connected to the upright wall (51*a*) at one of the hook grooves 514 (See FIG. 1). A front axle 511 and a rear axle 512 are rotatably provided on each side of the slide frame 51 adjacent to the front and rear ends thereof. A roller 510 is attached to the distal end of each front axle 511. The rollers 510 are movably provided in the curving section 411 of the rail groove 41 of the respective guide plate 4. A roller 513 is attached to the distal end of each rear axle 512. The rollers 513 are movably provided in the horizontal section 410 of the rail groove 41 of the respective guide plate 4.

The hook member 52 includes a pair of substantially V-shaped arms 522. The arms 522 are connected at one end via a connecting shaft 521. A pivot hole 523 is formed near the vertex of each arm 522. The front axles 511 extend through the pivot holes 523 to mount the hook member 52 on the front end of the slide frame 51. The pointed hook end of each arm 522 extends below the slide frame 51 (See FIG. 1). One end of the spring 54 is hooked to an intermediate portion of the connecting shaft 521. The other end of the spring 54 is connected to the hooking post 55. The hook member 52 can thus pivot about the front axles 511. When the hook end of the arms 522 bump into a moving obstacle, the hook member 52 pivots to permit the obstacle to move past the arms 522. When the obstacle has moved past the arms 522, the spring 54 urges the hook member 52 to return to its normal position.

Figure 4:
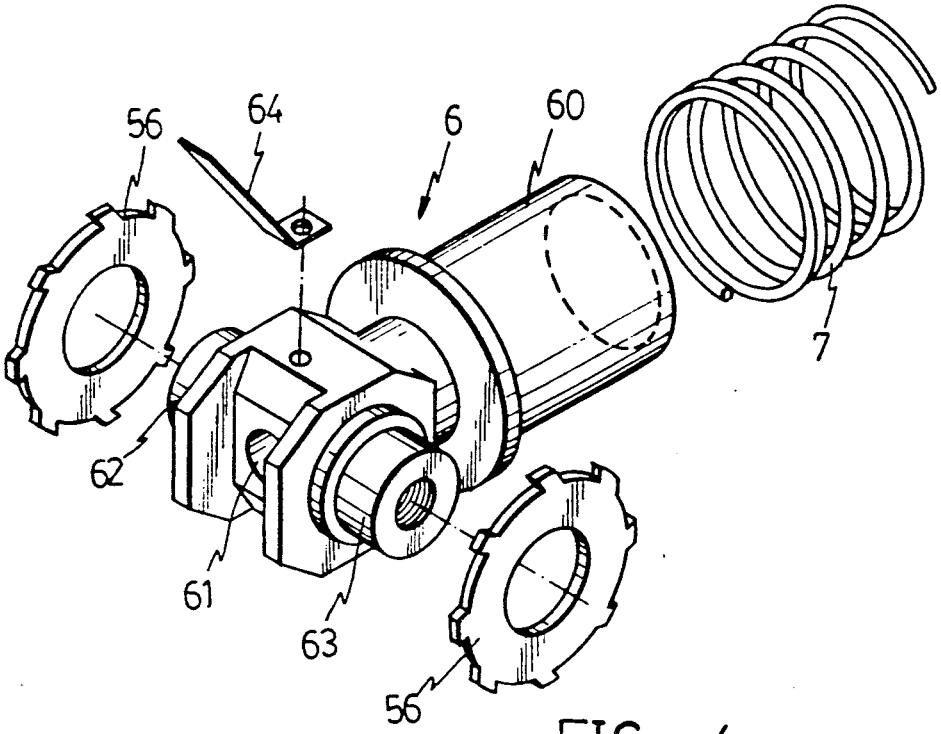
FIG. 4 is an exploded view of an axial seat of the preferred embodiment.

FIG. 4 is an exploded view of the axial seat 6 of the preferred embodiment. The top end of the axial seat 6 is provided with an upwardly inclining resilient guide strip 64. The front end of the axial seat 6 defines a receiving space to receive the head portion of a screw (not shown). A ratchet wheel 56 is rotatably provided on each of the mounting sockets, 62 and 63. A detailed discussion of how the hook member 52 engages the ratchet wheels 56 will be provided in the succeeding paragraphs.

Figure 5:
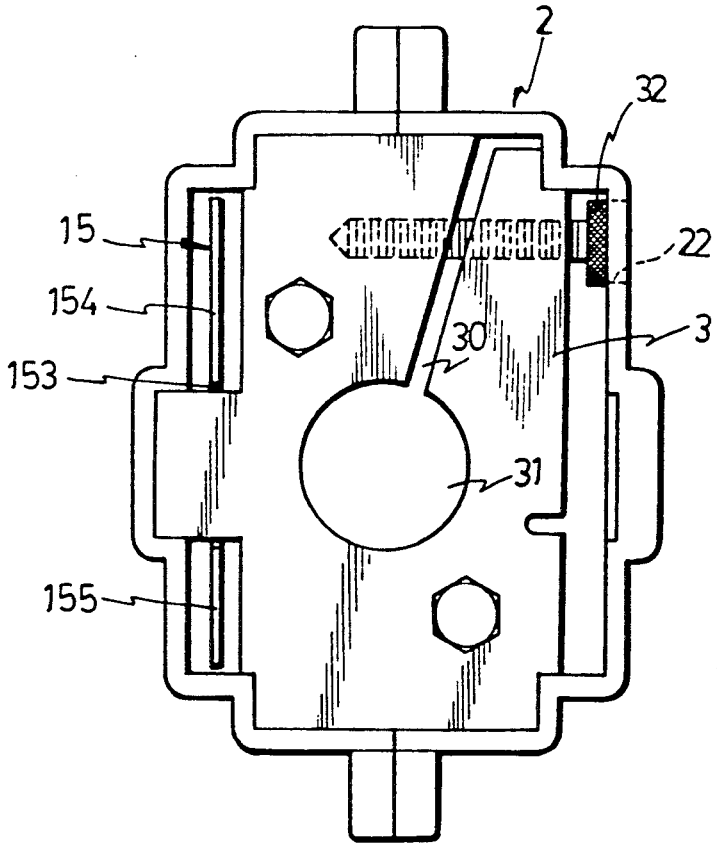
FIG. 5 is a rear view of the automatic screw feeding device of the present invention.

FIG. 5 is a rear view of the automatic screw feeding mechanism 1 of the preferred embodiment. The casing 2 comprises two casing halves, one of which has one side provided with a hole 22. The connector plate 3 is press fitted into the opening defined by the two casing halves. The connector plate 3 is further formed with a break 30 which is communicated with the central opening 31. An adjusting screw 32 has a head portion disposed in the hole 22 of the casing 2. The tip of the shaft portion of the adjusting screw 32 extends through the connector plate 3 past the break 30. The adjusting screw 32 is tightened or loosened to correspondingly vary the size of the break 30. When the adjusting screw 32 is tightened, the size of the break 30 is reduced to thereby cause a reduction in the size of the central opening 31. When the adjusting screw 32 is loosened, the break 30 is widened to thereby cause a slight expansion of the central opening 31.

The tail end of the resisting plate 15 is initially flushed with the outer side of the connector plate 3 and is provided with an elongated central notch 153. The notch 153 forms upper and lower ears, 154 and 155, on the tail end of the resisting plate 15. A portion of the connector plate 30 extends into the notch 153. The upper and lower ears, 154 and 155, can extend out of the rear end of the casing 2, as will be detailed later on.

Figure 6:
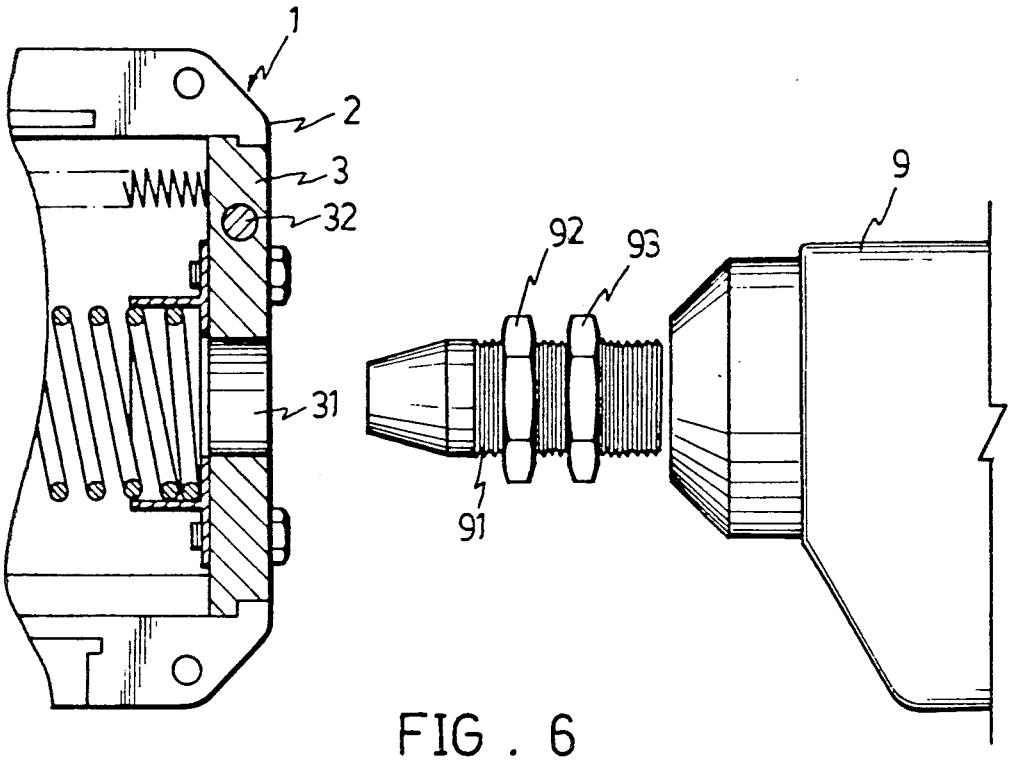
FIG. 6 illustrates how an electric drill is to be attached to the preferred embodiment.

Referring to FIG. 6, the automatic screw feeding mechanism 1 is to be attached to an electric drill 9 via a hollow connector head 91. The adjusting screw 32 is first operated so that the front end of the connector head 91 can be tightly clamped by the connector plate 3 at the central opening 31. The position of a locking nut 92 on the connector head 91 is then adjusted so as to tightly abut against the connector plate 3. The rear end of the connector head 91 is threadedly inserted into the front end of the electric drill 9. A tool bit (not shown) of the electric drill 9 passes through the connector head 91 and extends into the casing 2. Finally, the position of a locking nut 93 on the connector head 91 is then adjusted so as to tightly abut against the front end of the electric drill 9 to ensure tight and stable connection between the connector head 91 and the electric drill 9.

Referring once more to FIG. 1, a resilient pawl piece 57 is provided below each of the ratchet wheels 56. One end of each pawl piece 57 is mounted on the connecting rod 45 of a corresponding one of the guide plates 4. The free end of each pawl piece 57 extends into the teethed portion of one of the ratchet wheels 56. The pawl pieces 57 permit clockwise rotation of the ratchet wheels 56 but arrest motion of the ratchet wheels 56 in the opposite direction. Referring more closely to FIG. 1, the pawl pieces 57 engage the ratchet wheels 56 during counterclockwise rotation of the latter, thereby arresting movement of the ratchet wheels 56 in this direction. The pawl pieces 57, however, do not obstruct clockwise rotation of the ratchet wheels 56.

Referring again to FIG. 1, when the preferred embodiment is not in use, the primary and secondary biasing spring, 7 and 8, and the spring 54 on the hook means 5 are in an initial free state, i.e., no force is applied on the springs, 7, 8 and 54. The hook ends of the arms 522 engage one of the teeth on the respective ratchet wheel 56.

Figure 7:
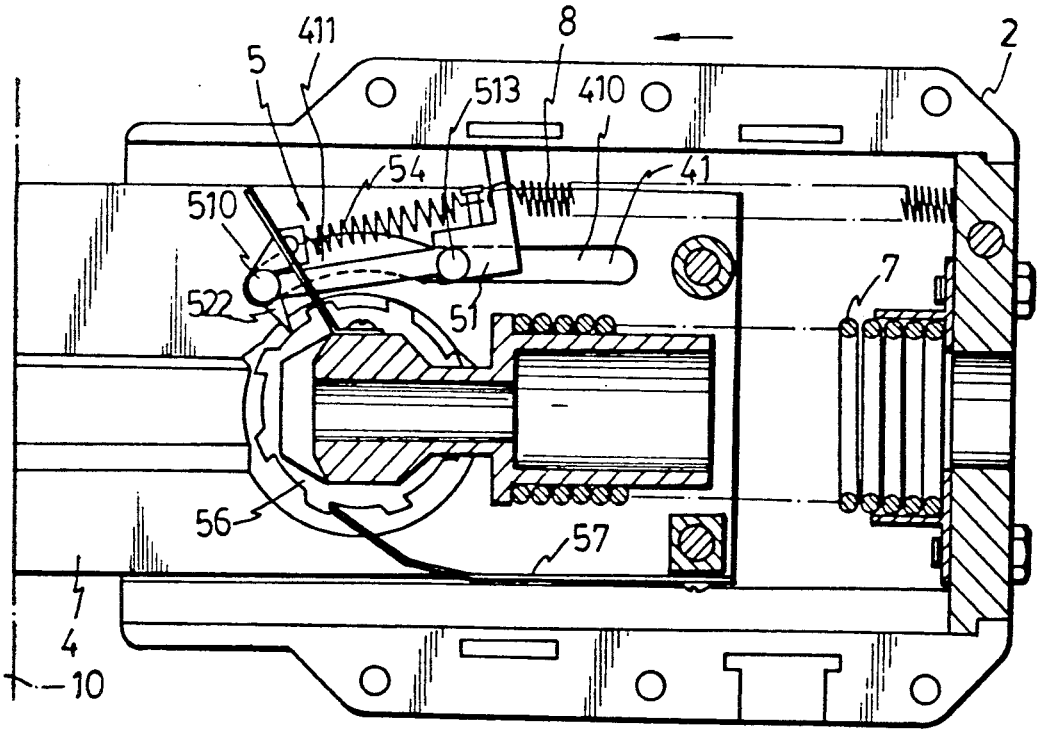
FIG. 7 is a sectional view of the preferred embodiment when it is in a screw driving position.

Referring to FIG. 7, the guide plates 4 are in a motionless state when the front ends thereof are placed against an operating surface 10. When the casing 2 is pushed toward the operating surface 10, the casing 2 slidably moves on the guide plates 4, thereby compressing the primary biasing spring 7. The secondary biasing springs 8 urge the slide frame 51 to move forward. Forward movement of the slide frame 51 causes the rollers 513 to move along the horizontal section 410 of the rail grooves 41 and the rollers 510 to move along the curving section 411 of the rail grooves 41. As the rollers 510 move to a terminating point of the curving section 411 of the rail grooves 41, the arms 522 of the hook member 52 bump into a succeeding one of the ratchet teeth of the ratchet wheels 56. The ratchet wheels 56 do not rotate at this stage since the counterclockwise rotations thereof are arrested by the pawl pieces 57. The arms 522 of the hook member 52 pivot about the front axles 511 as they move past the succeeding one of the ratchet teeth of the ratchet wheels 56, thereby applying tension on the spring 54. After the arms 522 have moved past the succeeding ratchet tooth, the spring 54 retracts to position the hook member 52 in its normal state. Further movement of the hook member 52 and the slide frame 51 are prevented when the rollers 510 reach the terminating point of the curving section 411 of the rail grooves 41. Further movement of the casing 2 toward the surface 10 is also prevented when the biasing springs, 7 and 8, are fully compressed.

Figure 8:
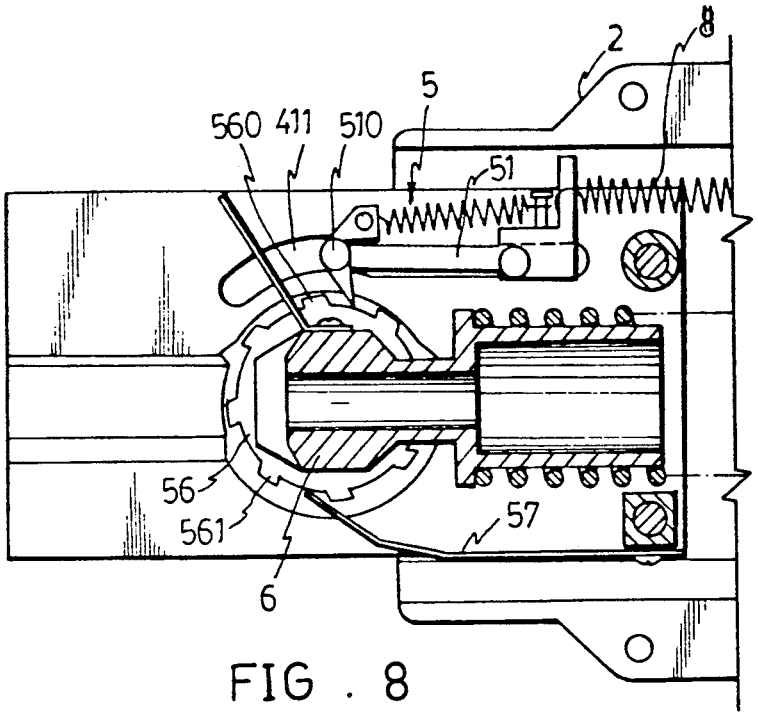
FIG. 8 is a sectional view of the front portion of the preferred embodiment when it is in one of its operating states.

Referring to FIG. 8, when the pressing force applied on the casing 2 is released, the primary biasing spring 7 expands to move the casing 2 away from the surface 10. The secondary biasing springs 8 also expand, thereby pulling the slide frame 51 rearward. The arms 522 similarly move rearward, and the rollers 510 move back to the starting point on the curving section 411 of the rail grooves 41. Since the curvature of the curving section 411 corresponds to that of the ratchet wheels 56, rearward movement of the arms 522 can cause clockwise movement of the ratchet wheels 56.

Because of the oscillations experienced by the secondary biasing springs 8, it is possible that the actual rotation of the ratchet wheels 56 will exceed a desired angular rotation. FIG. 1 illustrates the position of the arms 522 when the rotation of the ratchet wheels 56 is equivalent to the desired angular rotation. FIG. 8 illustrates the position of the arms 522 when the rotation of the ratchet wheels 56 have exceeded the desired angular rotation. Note that in the latter illustration, the arms 522 and the pawl pieces 57 are not in contact with the ratchet teeth of the ratchet wheels 56. When a pressing force is again applied on the casing 2, the slide frame 51 once more moves forward. Since the pawl pieces 57 are not in contact with the ratchet wheels 56 at this stage, when the arms 522 of the hook member 52 bump into the ratchet tooth 560 of the ratchet wheels 56, the ratchet wheels 56 rotate in a counterclockwise direction until the pawl pieces 57 contact the ratchet tooth 561 of the ratchet wheels 56, thereby arresting further counterclockwise movement of the ratchet wheels 56. The position of the preferred embodiment after the arms 522 have moved past the ratchet tooth 560 is shown in FIG. 7. It has thus been shown that a succeeding screw driving operation is not affected even though the rotation of the ratchet wheels 56 has exceeded the desired angular rotation in a former operation.

Figure 12:
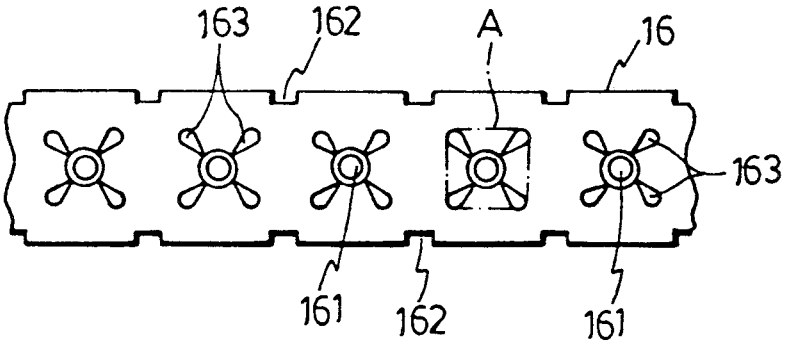
FIG. 12 is a top view of an elongated strap of the feed belt.

The preferred embodiment includes a feed belt. FIG. 12 is a top view of an elongated strap of the feed belt 16 when no screws are provided thereon. The strap of the feed belt has a plurality of spaced and aligned positioning rings 161 to receive the respective shaft portions of a plurality of screws (not shown). The two longitudinal sides of the strap are provided with a plurality of spaced pairs of guide notches 162. Each pair of guide notches 162 is located between two adjacent positioning rings 161. The strap of the feed belt 16 is further formed with a plurality of teardrop-shaped holes 163 disposed around the outer periphery of each positioning ring 161.

Figure 13:
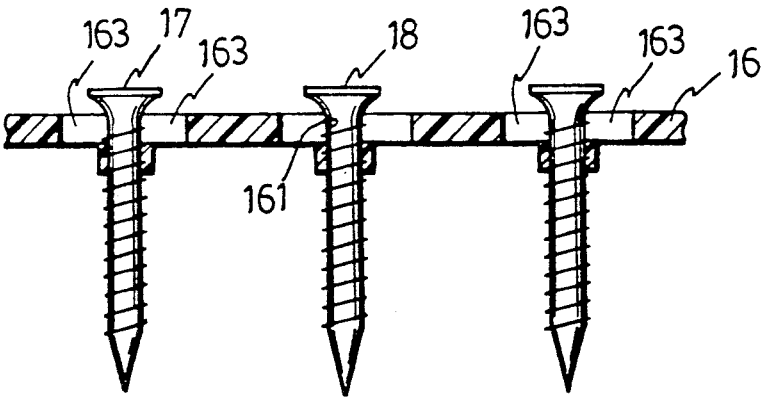
FIG. 13 is a sectional view of the feed belt of the automatic screw driving mechanism of the present invention.

Referring to FIG. 13, the opening defined by the positioning rings 161 of the feed belt 16 should be equal to or slightly smaller than the diameter of the shaft portion of the screws 17 or 18. (Of course, the openings of the positioning rings 161 must be smaller than the head portion of the screws 17 or 18). Referring once more to FIG. 12, the teardrop-shaped holes 163 are arranged in a diametrically opposite relationship. The pointed ends of the teardrop-shaped holes 163 converge at the periphery of the positioning rings 161. Thus, the regions (A) of the strap [each region (A) confines one of the positioning rings 161 and the teardrop-shaped holes 163 around the positioning ring 161] are relatively weak and can be easily torn apart. The size of the regions (A) should be larger than the head portion of the screws, 17 and 18. Thus, when force is applied on the head portion of the screw, 17 or 18, the corresponding region (A) on the strap is torn, thereby releasing the screw, 17 or 18, from the feed belt 16.

Figure 9:
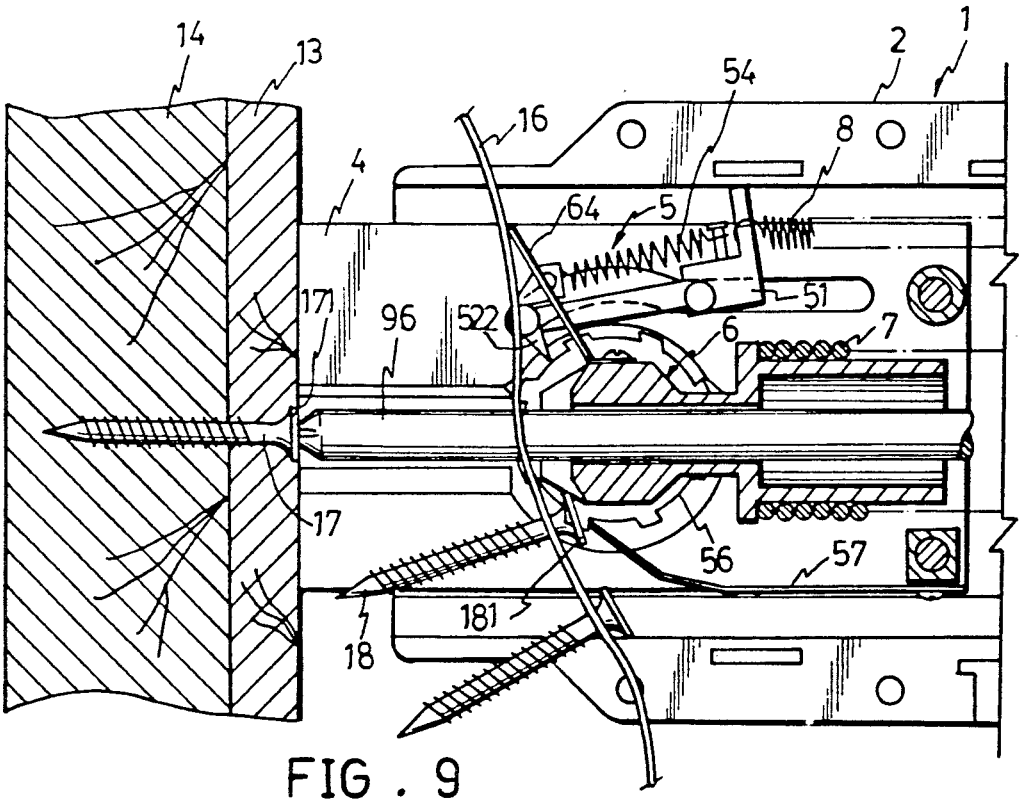
FIG. 9 is a sectional view of the front portion of the preferred embodiment when used with a feed belt.

To use the preferred embodiment, the automatic screw feeding mechanism 1 is firstly attached to the front end of the electric drill 9 (as shown in FIG. 6). The feed belt 16 is then provided in the front end of the automatic screw feeding mechanism 1. More specifically, the feed belt 16 is provided in the receiving space defined by the front end of the axial seat 6, as shown in FIG. 9. One of the pairs of guide notches 162 on the feed belt 16 respectively engages one of the ratchet teeth of the ratchet wheels 56. The head 171 of a first screw 17 is aligned with the tool bit 96 of the electric drill 9. To fasten together two objects, 13 and 14, the front ends of the guide plates 4 are firstly placed against the surface of one of the objects 13. The electric drill 9 is then pushed toward the object 13 to slidably move the casing 2 on the guide plates 4 so that the tip of the tool bit 96 can contact the head 171. The tool bit 96 rotates the screw 17 when the electric drill 9 is actuated. The electric drill 9 is then forced toward the object 13, causing the screw 17 to drill into the objects, 13 and 14, in order to fasten the same together. The pressure applied on the screw 17 enables the same to be released from the feed belt 16.

After the screw driving operation has been completed, the pressing force applied on the electric drill 9 is released, causing the primary biasing spring 7 to expand to thereby move the casing 2 away from the object 13. The secondary biasing springs 8 also expand, thereby pulling the slide frame 51 rearward. The arms 522 similarly move rearward to cause limited clockwise movement of the ratchet wheels 56. The ratchet wheels 56 vertically move the feed belt 16 by a corresponding distance so as to engage a succeeding pair of guide notches 162 and to position the head 181 of a second screw 18 directly in front of the tool bit 96. The preferred embodiment is now ready for a second screw driving operation.

The guide strip 64 prevents the torn or used portions of the feed belt 16 from affecting the succeeding screw driving operations. The distal end of the guide strip 64 abuts one side of the feed belt 16 and guides the used portions of the feed belt 16 to pass through the space between the guide plates 4 so they extend out of an upper notch provided on the front end of the casing 2. The unused portions of the feed belt 16 extend into the casing 2 via a lower notch similarly provided on the front end of the casing 2.

Figure 10:
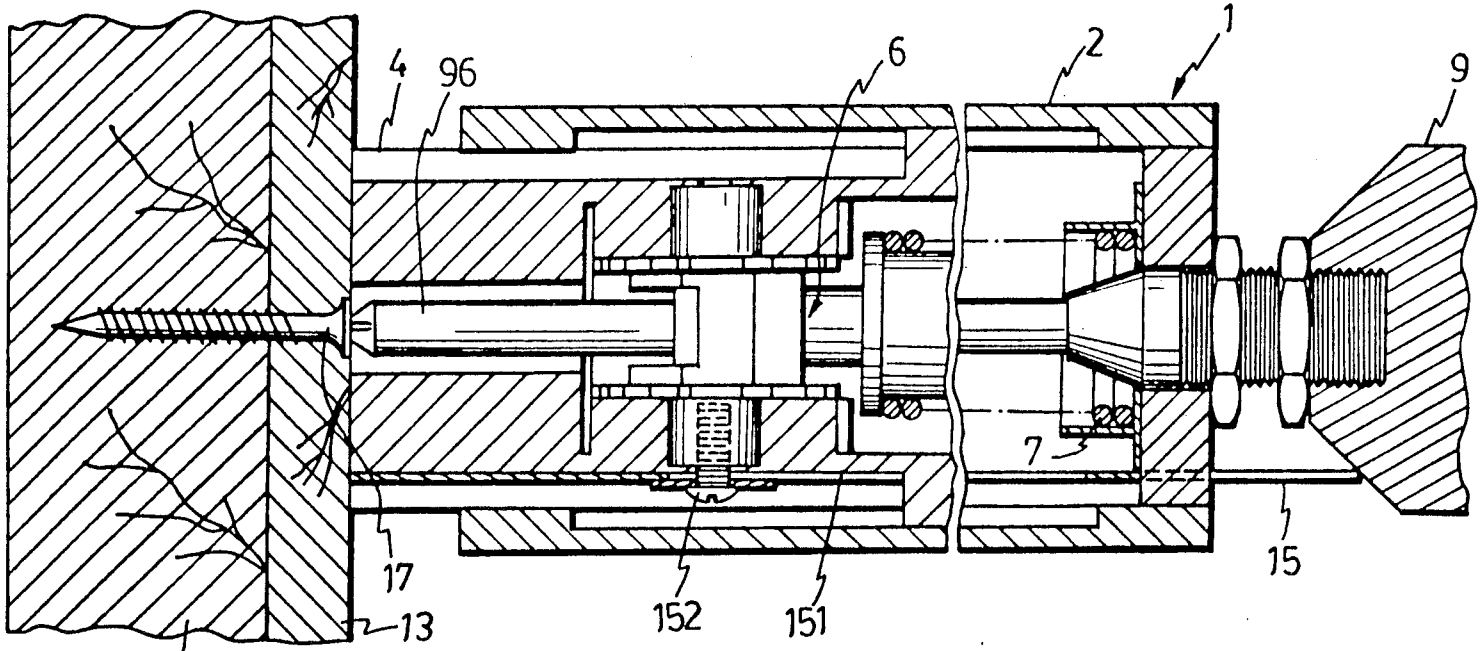
FIG. 10 is a transverse sectional view of the preferred embodiment during a screw driving operation.

Referring to FIG. 10, after the electric drill 9 has been operated so as to effectively fasten the objects 13 and 14, the tail end of the resisting plate 15 extends out of the casing 2 to abut against the front end of the electric drill 9. Further forward movement of the electric drill 9 is thus obstructed by the resisting plate 15. This is to indicate to the user that the screw driving operation has been completed and that the electric drill 9 can be deactivated.

The resisting plate 15 is provided with an adjusting slot 151 to control the screw driving motion according to the size of the screws on the feed belt 16. When the feed belt 16 is provided in the front end of the axial seat 6, it is possible that the tip of a first one of the screws will extend past the guide plates 4. The adjusting screw 152 is loosened, and the position of the resisting plate 15 is adjusted until the front edge of the resisting plate 15 is aligned with the tip of the first screw. The adjusting screw 152 is again tightened to lock the resisting plate 15 in this position. Thus, when using the preferred embodiment under this condition, it is the front end of the resisting plate 15, and not the front ends of the guide plates 4, which abuts against the operating surface.

A relatively long screw requires the electric drill 9 to travel a farther distance. If the position of the front end of the resisting plate 15 has been adjusted beforehand to correspond to the length of the screw, the degree of projection out of the casing 2 of the tail end of the resisting plate 15 is correspondingly reduced. Thus, the electric drill 9 can be operated to move relatively farther in distance before abutting the tail end of the resisting plate 15.

Figure 11:
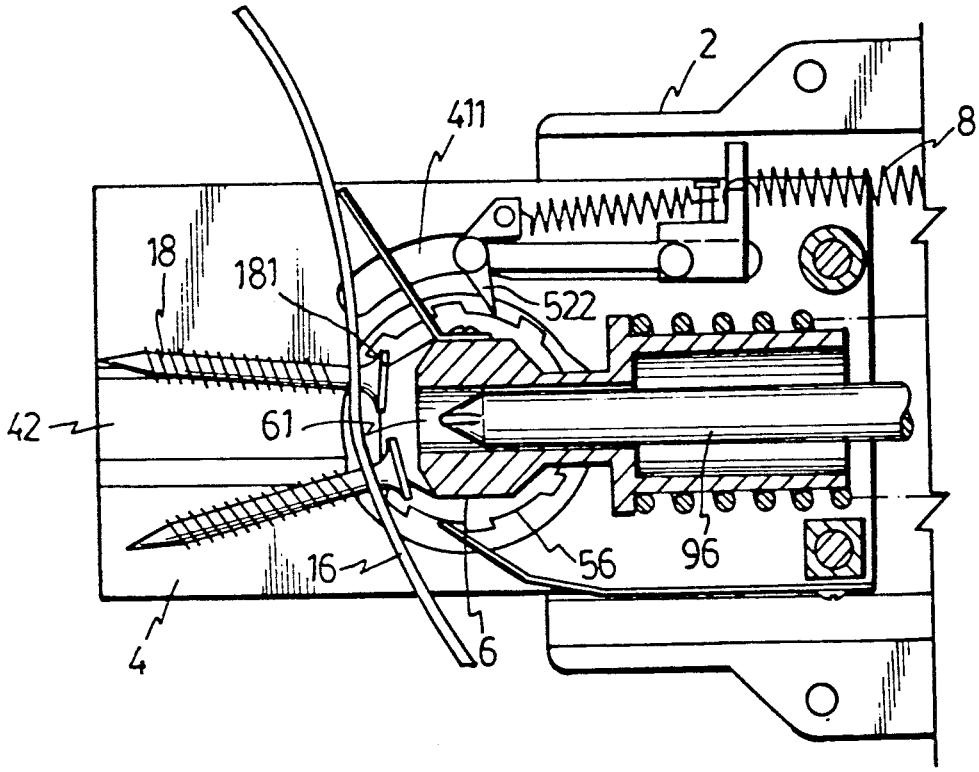
FIG. 11 is another sectional view of the front portion of the preferred embodiment when used with a feed belt.

Referring to FIG. 11, when the actual rotation of the ratchet wheels 56 has exceeded the desired angular rotation, the head 181 of the screw 18 is not aligned with the tool bit 96. Furthermore, the arms 522 and the pawl pieces 57 are not in contact with the ratchet teeth of the ratchet wheels 56. When a pressing force is applied on the casing 2, the slide frame 51 once more moves forward. Since the pawl pieces 57 are not in contact with the ratchet wheels 56 at this stage, when the arms 522 of the hook member 52 bump into one of the ratchet teeth of the ratchet wheels 56, the ratchet wheels 56 rotate in a counterclockwise direction, thereby moving the feed belt 16 downward. When the pawl pieces 57 contact the ratchet wheels 56, further counterclockwise movement of the ratchet wheels 56 is arrested. The head 181 of the screw 18 is aligned with the tool bit 96 at this stage. This illustrates that a succeeding screw driving operation is not affected even though the rotation of the ratchet wheels 56 has exceeded the desired angular rotation in a former screw driving operation.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. An automatic screw feeding mechanism for an automatic screw driving device, said automatic screw driving device including a rotatable tool bit and a rotating means for axially rotating said tool bit, said automatic screw feeding mechanism comprising:

a feed belt including an elongated strap formed with a plurality of spaced and aligned positioning rings, and a plurality of screws each having a shaft portion retained in one of said positioning rings, said strap having a longitudinal side provided with a plurality of spaced notches, each of said notches being disposed between two adjacent positioning rings;

a hollow casing having a rear open end and a front open end;

a connector plate mounted on said rear open end of said hollow casing, said connector plate having a central opening to releasably engage one end of said automatic screw driving device, said central opening serving as a passage for said tool bit;

a guide member provided inside said casing, said guide member having a front end extending out of said front open end of said casing, said front end of said guide member being engagable against an operating surface, said casing being slidably mounted on said guide member, said guide member including a pair of spaced guide plates and a connecting rod joining said guide plates;

an axial seat mounted between said guide plates and defining an axial opening aligned with said central opening of said connector plate, said axial seat having a ratchet wheel rotatably provided on one side thereof, said ratchet wheel having a periphery formed with a set of spaced ratchet teeth, said feed belt being provided between said guide plates in front of said axial seat, one of said ratchet teeth engaging one of said notches on said feed belt to align one of said screws with said axial opening of said axial seat;

a first spring means connecting said axial seat and said connector plate, said first spring means being compressed when said casing is urged by said automatic screw driving device to move from an initial position to a second position, wherein said tool bit extends into said axial opening to rotatably drive an aligned one of said screws into the operating surface and release said aligned one of said screws from said strap during a screw driving operation;

a hook means for rotating said ratchet wheel by a predetermined angular rotation when said first spring means expands to move said casing back to the initial position after the execution of a screw driving operation, said ratchet wheel being rotated by said hook means so that said ratchet wheel can engage a succeeding one of said notches on said feed belt in order to align a succeeding one of said screws with said axial opening;

each of said guide plates being formed with a rail groove, said rail groove having a horizontal section and a downwardly curving section disposed on a front end of said horizontal section, said curving section having a curvature corresponding to that of said ratchet wheel;

said hook means comprising a slide frame having a front roller pair movably provided in said curving section of said rail groove of said guide plates, a rear roller pair movably provided in said horizontal section of said rail groove of said guide plates, and a hooking post provided near a rear end of said slide frame; a second spring means connecting said slide frame and said connector plate; a hook member pivoted on a front end of said slide frame and having a pointed hook end extending into a toothed region of said ratchet wheel; a third spring means connecting one end of said hook member and said hooking post; and a pawl means associated with said ratchet wheel to arrest counterclockwise rotation of said ratchet wheel;

said second spring means urging said slide frame to move along said rail groove of said guide plates when said casing moves from the initial position to the second position, said hook end of said hook member moving past a first one of said ratchet teeth of said ratchet wheel as said front roller pair reaches a terminating end of said curving section of said rail groove, the movement of said casing back to the initial position causing said second spring means to pull said slide frame rearward and prompt said hook member to contact said first one of said ratchet teeth and cause limited clockwise movement of said ratchet wheel.

2. The automatic screw feeding mechanism as claimed in claim 1, wherein said pawl means comprises a resilient strip provided below said ratchet wheel and having a first end mounted on said connecting rod of said guide member and a second end extending into the teethed region of said ratchet wheel to arrest counterclockwise rotation of said ratchet wheel.

3. An automatic screw feeding mechanism for an automatic screw driving device, said automatic screw driving device including a rotatable tool bit and a rotating means for axially rotating said tool bit, said automatic screw feeding mechanism comprising:

a feed belt including an elongated strap formed with a plurality of spaced and aligned positioning rings, and a plurality of screws each having a shaft portion retained in one of said positioning rings, said strap having a longitudinal side provided with a plurality of spaced notches, each of said notches being disposed between two adjacent positioning rings;

a hollow casing having a rear open end and a front open end;

a connector plate mounted on said rear open end of said hollow casing, said connector plate having a central opening to releasably engage one end of said automatic screw driving device, said central opening serving as a passage for said tool bit;

a guide member provided inside said casing, said guide member having a front end extending out of said front open end of said casing, said front end of said guide member being engagable against an operating surface, said casing being slidably mounted on said guide member, said guide member including a pair of spaced guide plates and a connecting rod joining said guide plates;

an axial seat mounted between said guide plates and defining an axial opening aligned with said central opening of said connector plate, said axial seat having a ratchet wheel rotatably provided on one side thereof, said ratchet wheel having a periphery formed with a set of spaced ratchet teeth, said feed belt being provided between said guide plates in front of said axial seat, one of said ratchet teeth engaging one of said notches on said feed belt to align one of said screws with said axial opening of said axial seat;

a first spring means connecting said axial seat and said connector plate, said first spring means being compressed when said casing is urged by said automatic screw driving device to move from an initial position to a second position, wherein said tool bit extends into said axial opening to rotatably drive an aligned one of said screws into the operating surface and release said aligned one of said screws from said strap during a screw driving operation;

a hook means for rotating said ratchet wheel by a predetermined angular rotation when said first spring means expands to move said casing back to the initial position after the execution of a screw driving operation, said ratchet wheel being rotated by said hook means so that said ratchet wheel can engage a succeeding one of said notches on said feed belt in order to align a succeeding one of said screws with said axial opening; and each of said guide plates having an inner surface provided with an inward mounting projection, said mounting projection being formed with a mounting groove, said axial seat having a pair of oppositely extending mounting sockets projecting into said mounting groove of said guide plates to secure said axial seat to said guide plates, said ratchet wheel being provided around one of said mounting sockets.

4. The automatic screw feeding mechanism as claimed in claim 3, further comprising an elongated resisting plate provided on an outer side of one of said guide plates and formed with an elongated slot, and an adjusting screw extending through said elongated slot to mount said resisting plate to one of said mounting sockets, said resisting plate having a tail end projecting through said connector plate and out of said casing so as to abut against said automatic screw driving device to indicate that a screw driving operation has been successfully accomplished.

5. An automatic screw feeding mechanism for an automatic screw driving device, said automatic screw driving device including a rotatable tool bit and a rotating means for axially rotating said tool bit, said automatic screw feeding mechanism comprising:

a feed belt including an elongated strap formed with a plurality of spaced and aligned positioning rings, and a plurality of screws each having a shaft portion retained in one of said positioning rings, said strap having a longitudinal side provided with a plurality of spaced notches, each of said notches being disposed between two adjacent positioning rings;

a hollow casing having a rear open end and a front open end;

a connector plate mounted on said rear open end of said hollow casing, said connector plate having a central opening to releasably engage one end of said automatic screw driving device, said central opening serving as a passage for said tool bit;

a guide member provided inside said casing, said guide member having a front end extending out of said front open end of said casing, said front end of said guide member being engagable against an operating surface, said casing being slidably mounted on said guide member, said guide member including a pair of spaced guide plates and a connecting rod joining said guide plates;

an axial seat mounted between said guide plates and defining an axial opening aligned with said central opening of said connector plate, said axial seat having a ratchet wheel rotatably provided on one side thereof, said ratchet wheel having a periphery formed with a set of spaced ratchet teeth, said feed belt being provided between said guide plates in front of said axial seat, one of said ratchet teeth engaging one of said notches on said feed belt to align one of said screws with said axial opening of said axial seat;

a first spring means connecting said axial seat and said connector plate, said first spring means being compressed when said casing is urged by said automatic screw driving device to move from an initial position to a second position, wherein said tool bit extends into said axial opening to rotatably drive an aligned one of said screws into the operating surface and release said aligned one of said screws from said strap during a screw driving operation; and a hook means for rotating said ratchet wheel by a predetermined angular rotation when said first spring means expands to move said casing back to the initial position after the execution of a screw driving operation, said ratchet wheel being rotated by said hook means so that said ratchet wheel can engage a succeeding one of said notches on said feed belt in order to align a succeeding one of said screws with said axial opening; and said connector plate having an elongated break communicated with said central opening, said automatic screw feeding mechanism further comprising an adjusting screw extending through one side of said casing and into said connector plate past said elongated break, said adjusting screw being tightened or loosened to vary the size of said break to correspondingly adjust the size of said central opening.

6. An automatic screw feeding mechanism for an automatic screw driving device, said automatic screw driving device including a rotatable tool bit and a rotating means for axially rotating said tool bit, said automatic screw feeding mechanism comprising:

a feed belt including an elongated strap formed with a plurality of spaced and aligned positioning rings, and a plurality of screws each having a shaft portion retained in one of said positioning rings, said strap having a longitudinal side provided with a plurality of spaced notches, each of said notches being disposed between two adjacent positioning rings;

a hollow casing having a rear open end and a front open end;

a connector plate mounted on said rear open end of said hollow casing, said connector plate having a central opening to releasably engage one end of said automatic screw driving device, said central opening serving as a passage for said tool bit;

a guide member provided inside said casing, said guide member having a front end extending out of said front open end of said casing, said front end of said guide member being engagable against an operating surface, said casing being slidably mounted on said guide member, said guide member including a pair of spaced guide plates and a connecting rod joining said guide plates;

an axial seat mounted between said guide plates and defining an axial opening aligned with said central opening of said connector plate, said axial seat having a ratchet wheel rotatably provided on one side thereof, said ratchet wheel having a periphery formed with a set of spaced ratchet teeth, said feed belt being provided between said guide plates in front of said axial seat, one of said ratchet teeth engaging one of said notches on said feed belt to align one of said screws with said axial opening of said axial seat;

a first spring means connecting said axial seat and said connector plate, said first spring means being compressed when said casing is urged by said automatic screw driving device to move from an initial position to a second position, wherein said tool bit extends into said axial opening to rotatably drive an aligned one of said screws into the operating surface and release said aligned one of said screws from said strap during a screw driving operation;

a hook means for rotating said ratchet wheel by a predetermined angular rotation when said first spring means expands to move said casing back to the initial position after the execution of a screw driving operation, said ratchet wheel being rotated by said hook means so that said ratchet wheel can engage a succeeding one of said notches on said feed belt in order to align a succeeding one of said screws with said axial opening;

said casing having an inner surface formed with a pair of oppositely disposed longitudinal slide grooves, and each of said guide plates having an outer surface provided with an engaging projection, said engaging projection being disposed adjacent to a rear end of said guide plates and extending into one of said slide grooves to slidably mount said casing onto said guide plates.

7. An automatic screw feeding mechanism for an automatic screw driving device, said automatic screw driving device including a rotatable tool bit and a rotating means for axially rotating said tool bit, said automatic screw feeding mechanism comprising:

a feed belt including an elongated strap formed with a plurality of spaced and aligned positioning rings, and a plurality of screws each having a shaft portion retained in one of said positioning rings, said strap having a longitudinal side provided with a plurality of spaced notches, each of said notches being disposed between two adjacent positioning rings;

a hollow casing having a rear open end and a front open end;

a connector plate mounted on said rear open end of said hollow casing, said connector plate having a central opening to releasably engage one end of said automatic screw driving device, said central opening serving as a passage for said tool bit;

a guide member provided inside said casing, said guide member having a front end extending out of said front open end of said casing, said front end of said guide member being engagable against an operating surface, said casing being slidably mounted on said guide member, said guide member including a pair of spaced guide plates and a connecting rod joining said guide plates;

an axial seat mounted between said guide plates and defining an axial opening aligned with said central opening of said connector plate, said axial seat having a ratchet wheel rotatably provided on one side thereof, said ratchet wheel having a periphery formed with a set of spaced ratchet teeth, said feed belt being provided between said guide plates in front of said axial seat, one of said ratchet teeth engaging one of said notches on said feed belt to align one of said screws with said axial opening of said axial seat;

a first spring means connecting said axial seat and said connector plate, said first spring means being compressed when said casing is urged by said automatic screw driving device to move from an initial position to a second position, wherein said tool bit extends into said axial opening to rotatably drive an aligned one of said screws into the operating surface and release said aligned one of said screws from said strap during a screw driving operation; and a hook means for rotating said ratchet wheel by a predetermined angular rotation when said first spring means expands to move said casing back to the initial position after the execution of a screw driving operation, said ratchet wheel being rotated by said hook means so that said ratchet wheel can engage a succeeding one of said notches on said feed belt in order to align a succeeding one of said screws with said axial opening;

said axial seat having a top end provided with an upwardly inclining guide strip, said guide strip having a distal end abutting against one side of said feed belt so as to guide used portions of said feed belt to extend out of said casing and prevent the used portions from affecting succeeding screw driving operations.

8. An automatic screw feeding mechanism for an automatic screw driving device, said automatic screw driving device including a rotatable tool bit and a rotating means for axially rotating said tool bit, said automatic screw feeding mechanism comprising:

a feed belt including an elongated strap formed with a plurality of spaced and aligned positioning rings, and a plurality of screws each having a shaft portion retained in one of said positioning rings, said strap having a longitudinal side provided with a plurality of spaced notches, each of said notches being disposed between two adjacent positioning rings;

a hollow casing having a rear open end and a front open end;

a connector plate mounted on said rear open end of said hollow casing, said connector plate having a central opening to releasably engage one end of said automatic screw driving device, said central opening serving as a passage for said tool bit;

a guide member provided inside said casing, said guide member having a front end extending out of said front open end of said casing, said front end of said guide member being engagable against an operating surface, said casing being slidably mounted on said guide member, said guide member including a pair of spaced guide plates and a connecting rod joining said guide plates;

an axial seat mounted between said guide plates and defining an axial opening aligned with said central opening of said connector plate, said axial seat having a ratchet wheel rotatably provided on one side thereof, said ratchet wheel having a periphery formed with a set of spaced ratchet teeth, said feed belt being provided between said guide plates in front of said axial seat, one of said ratchet teeth engaging one of said notches on said feed belt to align one of said screws with said axial opening of said axial seat;

a first spring means connecting said axial seat and said connector plate, said first spring means being compressed when said casing is urged by said automatic screw driving device to move from an initial position to a second position, wherein said tool bit extends into said axial opening to rotatably drive an aligned one of said screws into the operating surface and release said aligned one of said screws from said strap during a screw driving operation; and a hook means for rotating said ratchet wheel by a predetermined angular rotation when said first spring means expands to move said casing back to the initial position after the execution of a screw driving operation, said ratchet wheel being rotated by said hook means so that said ratchet wheel can engage a succeeding one of said notches on said feed belt in order to align a succeeding one of said screws with said axial opening;

said elongated strap being formed with a plurality of holes disposed around the outer periphery of each of said positioning rings so as to facilitate the release of said screws from said strap; and said holes being teardrop-shaped holes having pointed ends that converge at the outer periphery of said positioning rings.

* * * * *